United States Patent [19]

Budzich

[11] 4,226,262

[45] Oct. 7, 1980

[54] LOAD RESPONSIVE CONTROL VALVE

[76] Inventor: Tadeusz Budzich, 80 Murwood Dr., Moreland Hills, Ohio 44022

[21] Appl. No.: 960,467

[22] Filed: Nov. 13, 1978

[51] Int. Cl.[3] ..... F15B 13/08

[52] U.S. Cl. ..... 137/596.13; 60/427; 91/464; 137/625.69

[58] Field of Search ..... 60/427; 91/464; 137/596.13, 625.69

[56] References Cited

U.S. PATENT DOCUMENTS

| | | | |
|---|---|---|---|
| 3,526,247 | 9/1970 | McMillen | 137/596.13 |
| 3,971,216 | 7/1976 | Miller | 137/596.13 |
| 4,089,169 | 5/1978 | Miller | 137/596.13 X |
| 4,109,561 | 8/1978 | Junck et al. | 137/596.13 X |
| 4,154,262 | 5/1979 | Blume et al. | 91/464 X |

OTHER PUBLICATIONS

SAE Paper No. 730,860: "Load—Sensitive Hydraulic System for Allis-Chalmers Models 7030 and 7050 Agricultural Tractors", by Ramkishan Khatti of Allis--Chalmers Corp.

*Primary Examiner*—Gerald A. Michalsky

[57] ABSTRACT

A load responsive flow control valve for use in a system controlling a plurality of loads. The system is powered by a single fixed displacement pump equipped with a load responsive bypass valve or a variable displacement pump equipped with load responsive control, which during simultaneous control of multiple loads automatically maintains the pump discharge pressure at a level higher by a constant pressure differential than the pressure required by the largest load being controlled. The load responsive valve is of a four position float type which in the float position while isolating system pump and connecting both of the load chambers to system reservoir blocks pressure sensing ports from inlet chamber and connects them to system reservoir to permit full unloading of the system pump.

8 Claims, 1 Drawing Figure

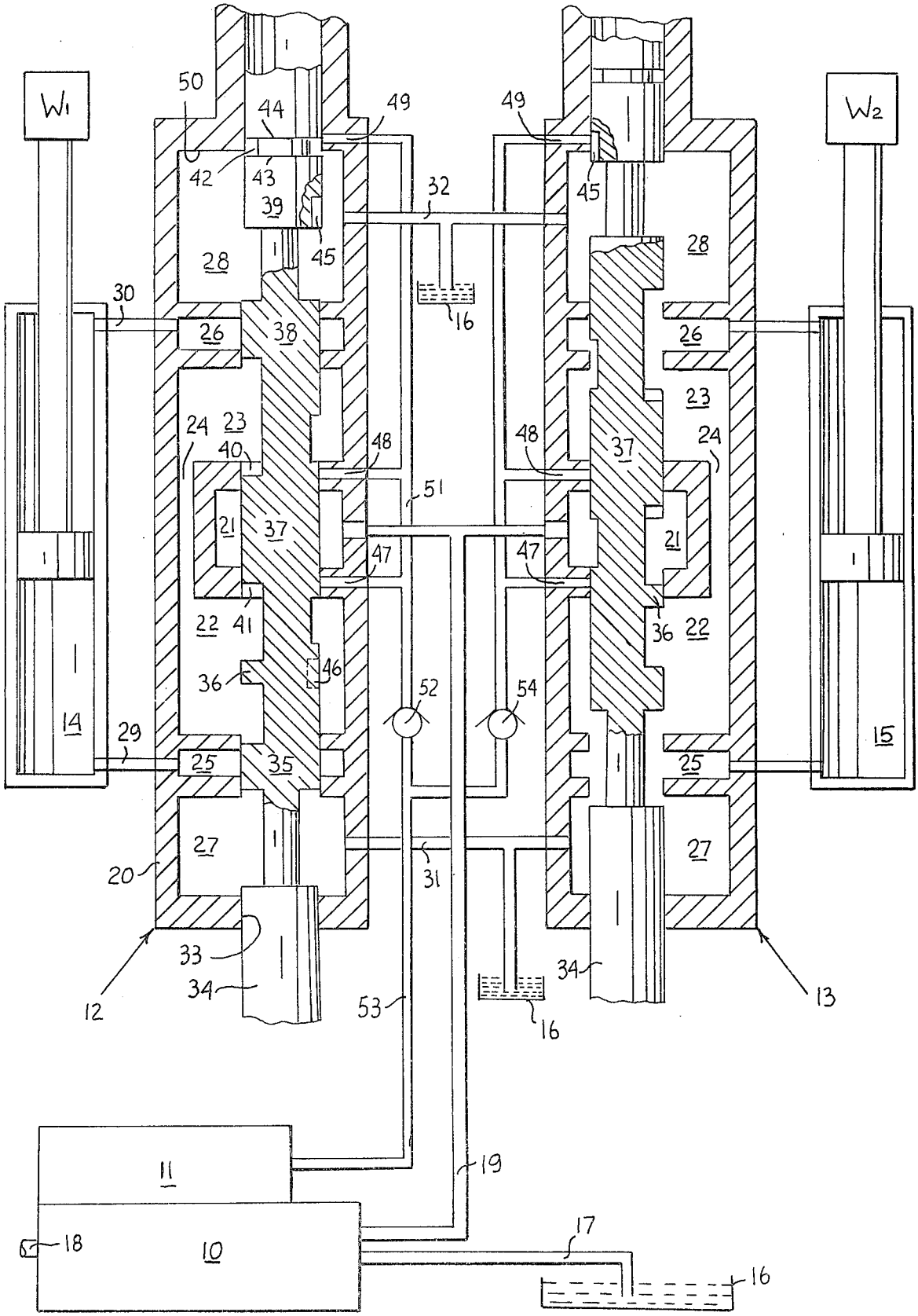
W1
W2
50
44
49
49
42
43
39
32
45
45
28
28
30
26
38
16
26
23
24
23
40
48
48
37
24
51
21
37
21
47
47
22
41
36
22
36
46
52
54
14
29
25
35
25
15
27
27
20
31
33
34
34
12
13
53
16
11
19
18
10
17
16

LOAD RESPONSIVE CONTROL VALVE

BACKGROUND OF THE INVENTION

This invention relates generally to pressure compensated load responsive control valves of direction control type, which in control of a load, while using a control load pressure sensing passage, automatically maintain pump discharge pressure at a level higher, by a constant pressure differential, than the pressure required by the controlled load, by either bypassing excess pump flow to system reservoir, or by varying displacement of the pump.

In more particular aspects this invention relates to load responsive direction control valves having load sensing ports and a control float position, in which the motor ports are connected to each other and to system reservoir and pump port is isolated.

The direction control valves with float position, in which the motor ports are connected to each other and to system reservoir, while pump is isolated, are well known in the art, and have been used in conventional fluid power circuits for many years. Those valves in the float position permit the free transfer between the motor ports and system reservoir, permitting the tool to float without using any of the pump flow. The use of such valves in a load responsive system presents new problems of dealing with load sensing ports in the float position.

SUMMARY OF THE INVENTION

It is therefore a principal object of this invention to block the load sensing ports in neutral and float positions of a load responsive direction control float type valve from the pump port and to connect them to system reservoir to permit full unloading of the system pump.

Briefly the foregoing and other additional objects and advantages of this invention are accomplished by providing in a load sensing circuit a load responsive float type valve with a feature of blocking the load sensing ports from pump port and connecting them to system reservoir in neutral and float positions of the valve, which permits in those positions of the valve unloading of the system pump to a minimum standby pressure.

Additional objects of the invention will become apparent from the following detailed description of the preferred embodiment thereof, which is schematically illustrated by a single figure of the accompanying drawing.

DESCRIPTION OF THE DRAWING

The single drawing shows diagramatically sections through two identical four position load responsive direction control valves with actuators, pump and other system components shown diagramatically.

DESCRIPTION OF THE PREFERRED EMBODIMENT

Referring now to the drawing the hydraulic system shown therein comprises a fluid pump 10, equipped with a flow control 11, which regulates delivery of the pump 10 into a load responsive circuit, composed of identical direction control valve assemblies, generally designated as 12 and 13, controlling actuators 14 and 15 subjected to loads $W_1$ and $W_2$. The pump 10 may be of fixed or variable displacement type. With the pump 10 being of fixed displacement type the flow control 11, in a well known manner, regulates delivery from the pump to load responsive circuit by bypassing part of the pump flow to a system reservoir 16. With the pump 10 being of variable displacement type the flow control 11, in a well known manner, regulates delivery from the pump 10 to load responsive circuit by changing the pump displacement. Although in the drawing, for purposes of demonstration of the principle of the invention, direction control valve assemblies 12 and 13 are shown separated and the flow control 11 is shown mounted on the pump 10, in actual application valve assemblies 12 and 13 and the flow control 11 would most likely be contained in a single valve housing, or would be bolted together as sections of a sectional valve assembly. As shown in the drawing fixed or variable displacement pump 10 has inlet line 17, which supplies fluid to pump from the reservoir 16 and the pump 10 is driven through a shaft 18 by a prime mover not shown. The pump 10 has an outlet line 19 through which pressurized fluid is supplied to direction control valve assemblies 12 and 13.

The direction control valve 12 has a valve housing 20, which defines an inlet chamber 21 connected by outlet line 19 to the pump 10, transfer chambers 22 and 23 connected by a passage 24, load chambers 25 and 26 and exhaust chambers 27 and 28. Load chambers 25 and 26 are connected by lines 29 and 30 to the chambers of the actuator 14. Exhaust chambers 27 and 28 are connected by lines 31 and 32 with system reservoir 16. The valve housing 20 is provided with a bore 33 interconnecting exhaust chambers 27 and 28, load chambers 25 and 26, transfer chambers 22 and 23 and the inlet chamber 21 and axially guiding valve spool 34. The valve spool 34 has lands 35, 36, 37, 38 and 39, metering slots 40 and 41, unloading groove 42 with timing surfaces 43 and 44, unloading slot 45 and optional slot 46. The housing 20 is also provided with load sensing ports 47 and 48, unloading port 49 and cutoff surface 50. Load sensing ports 47 and 48 and unloading port 49 are connected through line 51, check valve 52 and signal line 53 with the flow control 11 of the pump 10. The flow control valve 13 is identical to flow control valve 12 with its valve spool 34 displaced to free floating control position. The load sensing and unloading circuit of flow control valve 13 is connected through check valve 54 with signal line 53. The same components and features of control valve 13 are denoted by the same numbers as those of control valve 12.

Control valve, generally designated as 12, is shown in its neutral position with lands of valve spool 34 blocking load chambers 25 and 26, the inlet chamber 21 and load sensing ports 47 and 48, while unloading groove 42 opens by timing surface 43 the unloading port 49 to the exhaust chamber 28, which is connected to the system reservoir 16. Therefore reservoir pressure is transmitted through line 51, check valve 52 and signal line 53 to the flow control 11. If a similar signal is transmitted from control valve 13, the flow control 11, in a well know manner, will maintain the pressure in outlet line 19 of the pump 10 at a minimum standby pressure level.

Assume that the flow control valve 13 transmits from its load sensing circuit through check valve 54 to signal line 53 a zero pressure signal. Assume also that the valve spool 34 of flow control valve 12 was displaced in either direction from its neutral position. Initial displacement in either direction of the valve spool 34 will disconnect the unloading port 49 from the exhaust chamber 28. Upward movement of valve spool 34 will displace timing surface 43 past cutoff surface 50, isolating the unloading port 49, while by displacement of land 38 connecting the load chamber 26 with transfer chambers 22 and 23. Downward movement of valve spool 34, through displacement of timing surface 44, will isolate the unloading port 49, while by displacement of land 35 connecting the load chamber 25 with transfer chambers 22 and 23.

Further displacement of the valve spool 34 in either direction will open load sensing port 47 or 48 to the transfer chamber 22 or 23, subjected to load pressure of load chamber 25 or 26, while land 37 still isolates the inlet chamber 21 from transfer chambers 22 and 23 and lands 35 and 38 still isolate loads chamber 25 or 26 from exhaust chambers 27 or 28. Load pressure signal transmitted from load sensing port 47 or 48 to line 51 will open the check valve 52, close the check valve 54 and will react through signal line 53 on the flow control 11. The flow control 11, in a well known manner, will adjust the pressure in outlet line 19, to maintain a constant pressure differential between discharge pressure of the pump 10 and load signal pressure in signal line 53.

Still further displacement of the valve spool 34 will connect through metering slot 40 or 41 the inlet chamber 21 with transfer chambers 22 and 23, while simultaneously connecting one of the load chambers 25 or 26 to one of the exhaust chambers 27 or 28. Since a constant pressure differential is automatically maintained by the flow control 11 between the inlet chamber 21 and transfer chambers 22 and 23 connected to one of the load chambers 25 or 26, constant flow, proportional to the effective area of metering orifice 40 or 41 connected to the transfer chambers, will be delivered to load chamber 25 or 26. Since the flow from the inlet chamber 21 is proportional to the effective area of metering orifice it is also proportional to the displacement of the valve spool 34, thus controlling the velocity of the load $W_1$.

With the valve spool 34 of flow control valve 12 in neutral position and the valve spool 34 of flow control valve 13 moved upward all the way, as shown in the drawing, the flow control valve 13 is in a float position. In this control position load chambers 25 and 26 are interconnected with each other through transfer chambers 22 and 23 and passage 24 and also are connected with exhaust chambers 27 and 28, while being isolated by lands 36 and 37 from the inlet chamber 21. Load sensing ports 47 and 48 are blocked by lands 36 and 37 and the unloading port 49 is connected by unloading slot 45 with the exhaust chamber 28, thus unloading the control pressure sensing circuit and transmitting a zero control signal to the check valve 54 and the flow control 11. Therefore in float control position, while under the influence of the load $W_2$ fluid transfer can freely take place from one port to the other of the actuator 15 and the piston of the actuator can float and find its own equilibrium position, the load sensing circuit of the flow control valve is unloaded and transmits low pressure signal to the flow control 11, permitting the pump 10 to be maintained at minimum standby pressure level, corresponding to the minimum system horsepower loss.

With the valve spool 34 in float position the pressure sensing circuit can be additionally unloaded by optional slot 46 fully shown on the valve spool 34 of flow control valve 12 and shown in dotted lines on the valve spool 34 of flow control valve 13. In float position the optional slot 46 directly connects load sensing port 47 with the transfer chamber 22. During very fast fluid transfer between load chambers 25 and 26, due to resistance to flow, transfer chambers 22 and 23 may be subjected to comparatively high pressure, which would be transmitted through load sensing port 47 to the flow control 11. Therefore the method of unloading the load sensing circuit by unloading port 49 is preferable, since possible pressure variations due to floating action in the exhaust chamber 28 are comparatively small.

Although the preferred embodiment of this invention has been shown and described in detail it is recognized that the invention is not limited to the precise form and structure shown and various modifications and rearrangements as will readily occur to those skilled in the art upon full comprehension of this invention may be resorted to without departing from the scope of the invention as defined in the claims.

What is claimed is:

1. A load responsive valve assembly comprising at least one valve housing having an inlet chamber, first and second load chambers, at least one exhaust chamber, and load sensing port means operable through signal conducting passage means to transmit load pressure signal to output flow control means of a pump, direction control means for selectively interconnecting and isolating said chambers and said load sensing port means in a number of control positions including a neutral position and a float position, in said float position said direction control means having means for interconnecting said first and second load chambers with said exhaust chamber, means for isolating said inlet chamber from said first and second load chambers and said exhaust chamber, means on said direction control means for blocking said load sensing port means, and means for connecting said signal conducting means with said exhaust chamber down stream of passages connecting said load chambers with said exhaust chambers.

2. A load responsive valve assembly as set forth in claim 1 wherein in said neutral position said direction control means includes blocking means operable to block said pressure sensing port means from said first and second load chambers and said inlet chamber, and connecting means operable to connect said signal conducting means to said exhaust chamber.

3. A load responsive valve assembly as set forth in claim 1 wherein said means for connecting said signal conducting means with said exhaust chamber includes unloading port means and bidirectional blocking means operable to block said unloading port means when said direction control means is displaced in either direction from said neutral position.

4. A load responsive valve assembly as set forth in claim 1 wherein said means for connecting said signal conducting means with said exhaust chamber includes unloading port means and interconnecting means on said direction control means operable to interconnect said unloading port means and said exhaust chamber in said float position.

5. A load responsive valve assembly as set forth in claim 1 wherein check valve means in said signal conducting passage means is interposed for one way fluid flow between said load sensing port means and said output flow control of said pump.

6. A load responsive valve assembly as set forth in claim 1 wherein said output flow control means of a pump includes pump displacement changing means.

7. A load responsive valve assembly as set forth in claim 1 wherein said output flow control means of a pump includes pump flow bypassing means.

8. A load responsive valve assembly comprising at least one valve housing having an inlet chamber, first and second load chambers, at least one exhaust chamber, and load sensing port means operable through signal conducting passage means to transmit load pressure signal to output flow control of a pump, direction control means for selectively interconnecting and isolating said chambers and said load sensing port means in a number of control positions including a neutral position and a float position, in said float position said direction control means having means for interconnecting said first and second load chambers with said exhaust chamber, means for isolating said inlet chamber from said first and second load chambers and said exhaust chamber, means for blocking said load sensing port means, and means responsive to movement of said direction control means having means for connecting said signal conducting means with said exhaust chamber.

* * * * *